US006382422B1

(12) United States Patent
Bocek

(10) Patent No.: US 6,382,422 B1
(45) Date of Patent: May 7, 2002

(54) PACKAGING SYSTEM FOR A FAMILY OF PRODUCTS

(75) Inventor: Patricia R. Bocek, Loveland, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/660,673

(22) Filed: Sep. 13, 2000

(51) Int. Cl.[7] ..... B65D 81/02
(52) U.S. Cl. ..... 206/586; 206/592
(58) Field of Search ..... 206/586, 587, 206/591, 592, 320, 523, 453, 1.5; 220/4.31, 4.33

(56) References Cited

U.S. PATENT DOCUMENTS 3,410,474 A * 11/1968 Keil ..... 206/586
5,398,808 A * 3/1995 Chen et al. ..... 206/320
6,082,543 A * 7/2000 Beliveau ..... 206/523

* cited by examiner

*Primary Examiner*—Shian Luong

(57) ABSTRACT

A packaging system and a method for packaging a family of products. The packaging system may comprise a top cushion and an identical bottom cushion. The top and bottom cushions may interchangeably be placed on the top or bottom side of any of the products in the family. The packaging system may further comprise a plurality of side cushions adapted to be placed on the sides of a product. The side cushions have at least one break-away portion, allowing them to be utilized on any of the products in the family, whether the product is comprised of one, two, or three or more units. Each of the cushions have interlocking portions adapted to securely, removably interlock the top cushion and the bottom cushion with the side cushions to form a packaging unit.

18 Claims, 11 Drawing Sheets

PACKAGING SYSTEM FOR A FAMILY OF PRODUCTS

FIELD OF THE INVENTION

The present invention relates generally to product packaging, and more particularly to packaging systems adapted for use with a family of products.

BACKGROUND OF THE INVENTION

Products such as computers, electronics, autochangers, and the like are fragile and must be securely packaged for transportation. Flexible cushions surrounding a product have been used to protect the product as it is transported on a pallet, dolly, or the like, transferred to a corrugated box, and then shipped to a customer. These flexible cushions may be manufactured from an impact-absorbent material such as expanded polystyrene or the like. Each cushion may have an inner surface which abuts a particular side of the product being transported and an outer surface which abuts the inner surface of the corrugated box. Typically, each product would have associated therewith a top cushion, a bottom cushion, and at least two side cushions.

A family of products may be comprised of a plurality of units in different combinations. For example, an autochanger family may be comprised of three separate products: a one-unit product, a two-unit product having two units stacked one on top of the other, and a three-unit product having three units stacked one on top of another. Each of these products may have associated therewith four to six cushions, whereby at least the side cushions are typically not interchangeable among the products. Thus, a family of three products would require up to eighteen separate packaging cushions.

Furthermore, these cushions are usually separate pieces which do not interlock in any manner or fit securely on the product. Thus, one or more cushions may easily fall off the product as it is being transferred to or taken out of a corrugated box. Should one or more cushions have cutouts on the outer side thereof for accessories such as cords, documentation, etc., a cushion which falls off the product, for example as a customer is opening the box, may result in the loss or damage of such accessories.

Thus, it is an object of the present invention to provide a simplified packaging system by reducing the total number of packaging cushions associated with a family of products, thereby lowering packaging costs and reducing the manufacturing floor space required for the cushions.

It is also an object of the present invention to provide a packaging system comprising interchangeable cushions for a family of products.

It is also an object of the present invention to provide a packaging system having break-away cushions which are easily adapted for use with a family of products having varying heights.

It is a further object of the present invention to provide a packaging system having cushions which securely interlock on a product.

SUMMARY OF THE INVENTION

The present invention is directed to a packaging system for a family of products that may be comprised of a plurality of units in varying combinations. The packaging system may comprise a top cushion adapted to be placed on the top side of any of the products in the family, and a bottom cushion which is identical to and interchangeable with the top cushion and is adapted to be placed on said bottom side of any of the products in the family. The packaging system may further comprise two to four side cushions adapted to be placed on the sides of a product in the family. The side cushions have at least one break-away portion which allows them to be utilized on more than one product in the family, whether the product is comprised of one, two, or three or more units. Each of the cushions have interlocking portions adapted to securely, removably interlock the top cushion and the bottom cushion with the side cushions to form a packaging unit. Removing the side cushions unlocks the packaging unit. The interlocking portions may be comprised of extending portions received within receiving portions on each of the cushions. Any of the cushions may comprise at least one cutout portion adapted to receive and retain accessories. The top/bottom cushion may comprise a plurality of relief areas which allow a customer, forklift, etc., to grasp the packaged product.

The present invention may also be directed to a method for packaging a family of products. First, a top cushion, a bottom cushion which is interchangeable with the top cushion, a first side cushion and a second side cushion each having a plurality of break-away portions are provided. Next, a top cushion is placed on the top side and a bottom cushion is placed on the bottom side of one of the products. Depending on how many units the product is comprised of, the next step may comprise breaking off at least one of the break-away portions of the each of the side cushions. Finally, each of the side cushions are placed on the sides of the product so that the side cushions interlock with the top and bottom cushions.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
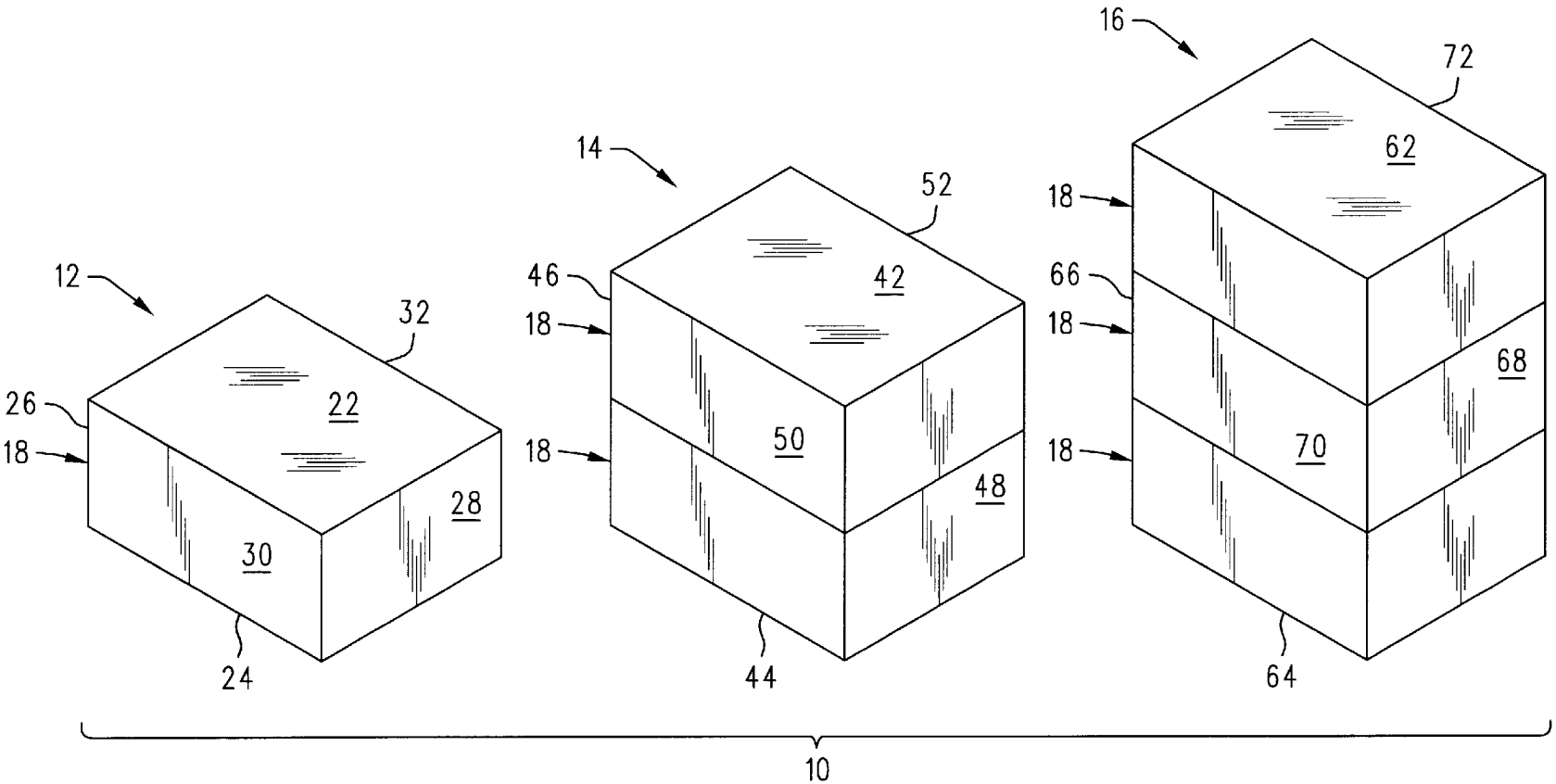
FIG. 1 is a schematic illustration of a family of products on which the packaging system of the present invention may be utilized.

FIG. 1 is a schematic illustration of a family 10 of products 12, 14, 16 on which the packaging system 100

(FIGS. 2 and 3) of the present invention may be utilized. The products 12, 14, 16 may be, for example, autochangers or the like which may be comprised of substantially identical units 18 in varying combinations. It is to be understood, however, that the packaging system 100 of the present invention is not limited to use on an autochanger. Instead, the packaging system 100 may be utilized on a family of products comprised of identical or diverse units, as discussed in more detail below.

As shown in FIG. 1, the first product 12 may be a one-unit product comprising a single unit 18, the second product 14 may be a two-unit product comprising two units 18 stacked one on top of the other, and the third product 16 may be a three-unit product comprising three stacked units 18. The first product 12 may comprise a top side 22, a bottom side 24, a first side 26, a second side 28, a third side 30, and a fourth side 32. The second product 14 may comprise a top side 42, a bottom side 44, a first side 46, a second side 48, a third side 50, and a fourth side 52. The third product 16 may comprise a top side 62, a bottom side 64, a first side 66, a second side 68, a third side 70, and a fourth side 72.

Figure 2:
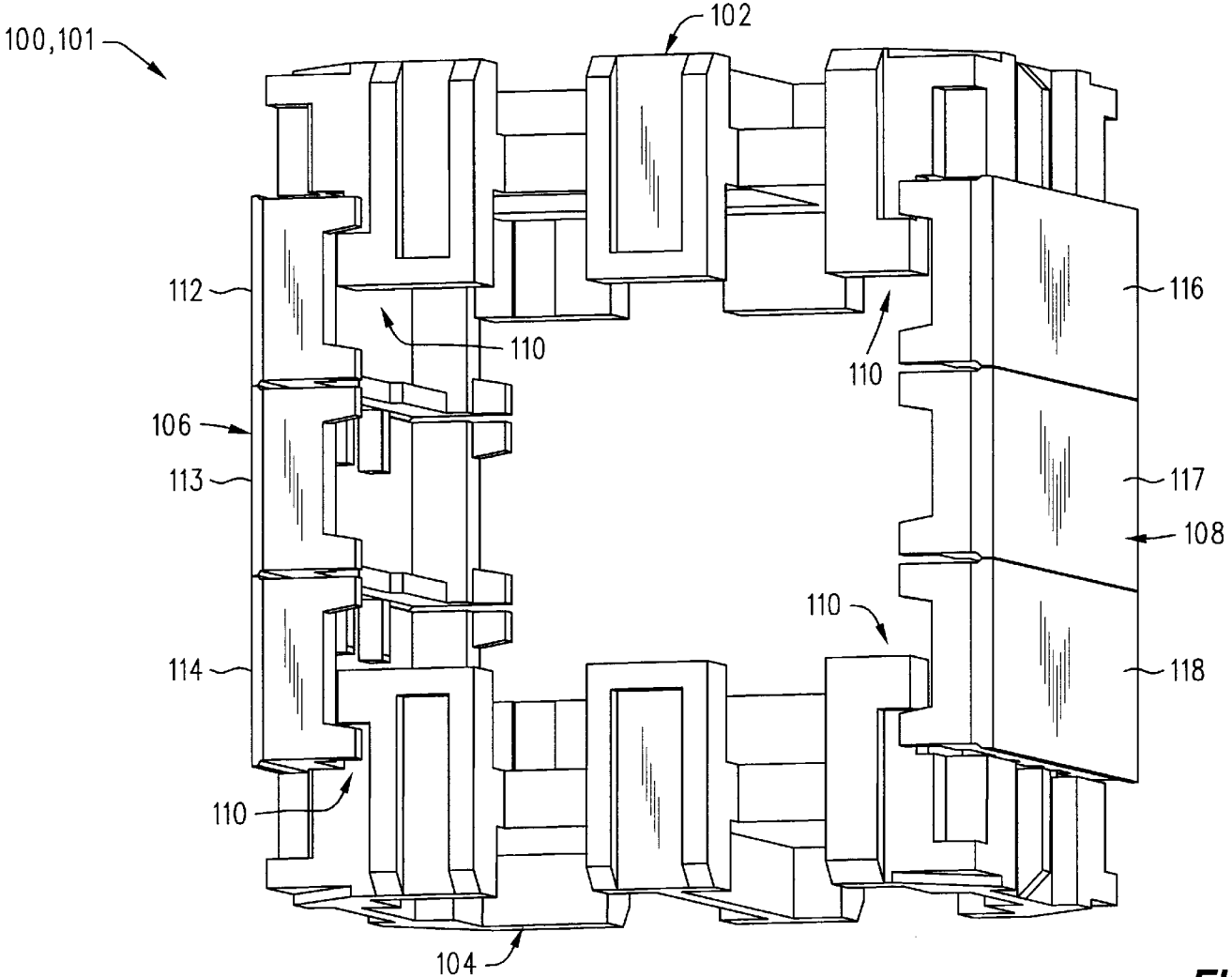
FIG. 2 is an isometric view of the packaging system of the present invention.
Figure 3:
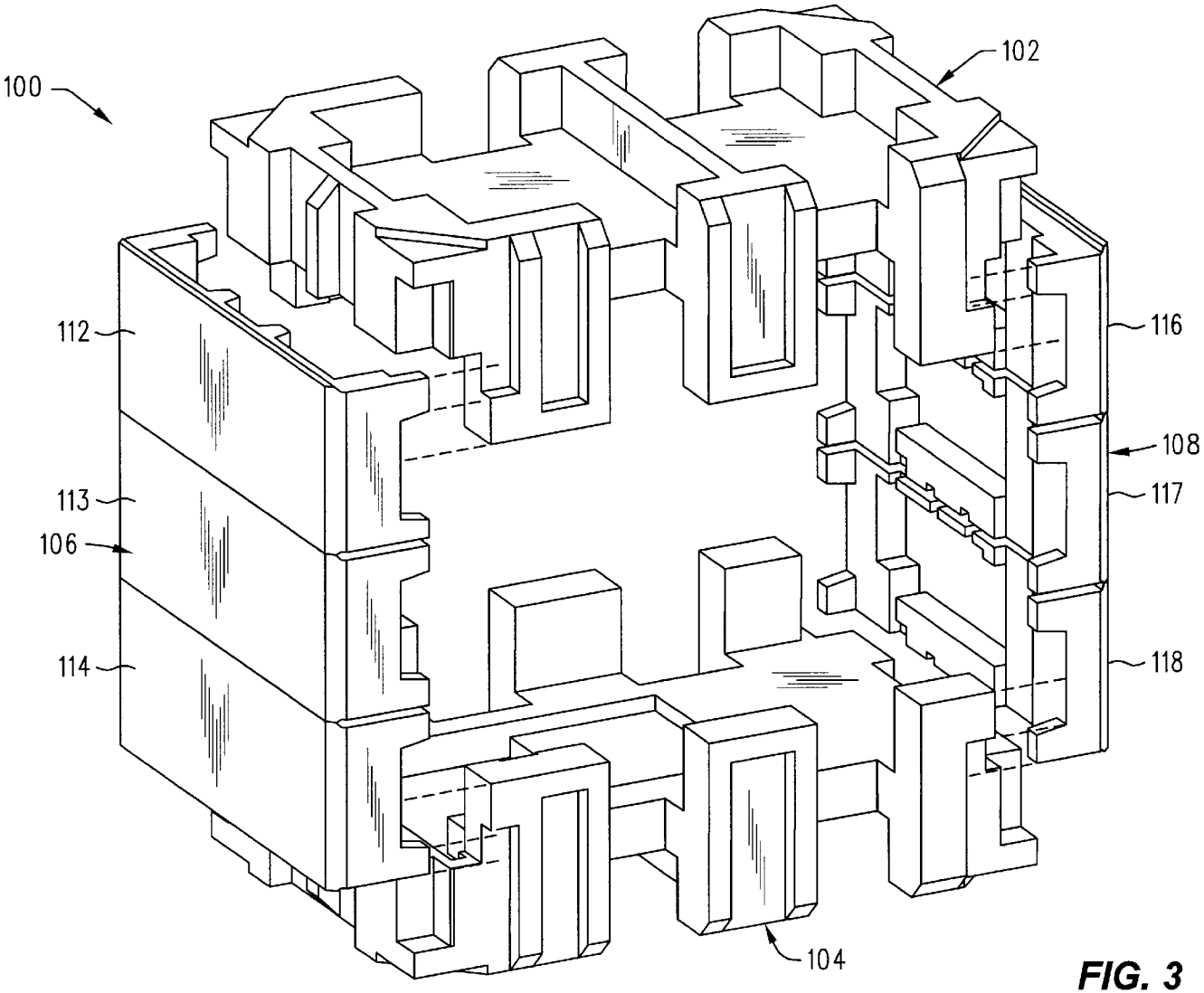
FIG. 3 is a partially exploded isometric view of the packaging system of FIG. 2.

A packaging system 100 for a three-unit product 16 (FIG. 1) is shown in FIGS. 2 and 3. With reference also to FIG. 1, the packaging system 100 may comprise a top cushion 102 adapted to be placed on the top side 22, 42, 62 of a product 12, 14, 16; a bottom cushion 104 adapted to be placed on the bottom side 24, 44, 64 of a product 12, 14, 16; a first side cushion 106 adapted to be placed on a first side 26, 46, 66 of a product 12, 14, 16; and a second side cushion 108 adapted to be placed on a second side 28, 48, 68 of a product 12, 14, 16. These cushions 102, 104, 106, 108 will be described in more detail with reference to FIGS. 4–10 below. As shown in FIG. 2, the cushions 102, 104, 106, 108 comprise interlocking portions 110 adapted to securely, removably interlock the top cushion 102 and the bottom cushion 104 with the first side cushion 106 and the second side cushion 108 on the product 16 to form a single packaging unit 101, FIG. 2. As indicated in FIG. 3, which is a partially exploded isometric view, removing the side cushions 106, 108 unlocks the packaging unit. While only two side cushions 106, 108 are shown and described in the figures, a third side cushion and a fourth side cushion (not shown) may also be provided which are adapted to be placed on the third side 30, 50, 70 and fourth side 32, 52, 72, respectively, of a product 12, 14, 16 in order to form a fully-enclosed packaging unit (not shown). As with the first and second side cushions 106, 108, the third and fourth side cushions must also be removed prior to removing the top and is bottom cushions 102, 104 in order to unlock the packaging unit. All of the cushions may be manufactured from an impact-absorbent material such as expanded polystyrene or the like, or from any suitable packaging material.

The packaging system 100 shown in FIGS. 2 and 3 may be utilized on a one-unit product 12 or a two-unit product 14 (FIG. 1) by breaking away portions of the side cushions 106, 108 prior to placing them on the product. As shown in FIGS. 2 and 3 and explained in further detail below with reference to FIGS. 7–10, the first side cushion 106 may comprise break-away portions 112, 113, 114 and the second side cushion 108 may comprise break away portions 116, 117, 118 which are preferably identical to break-away portions 112, 113, 114. For a one-unit product 12 (FIG. 1), two break-away portions would be broken away on each side cushion, e.g., portions 113 and 114 on the first side cushion 106 and portions 117 and 118 on the second side cushion 108, leaving a single break-away portion on each side cushion, e.g., portions 112 and 116 on cushions 106, 108, respectively. For a two-unit product 14 (FIG. 1), one break-away portion would be broken away on each side cushion, e.g., portion 114 on the first side cushion 106 and portion 118 on the second side cushion 108, leaving two-break-away portions on each side cushion, e.g., portions 112, 113 and 116, 117 on cushions 106, 108, respectively. It should be noted that the broken-away portions need not be discarded and may be utilized on other units, i.e., a single side cushion may be used to package both a one-unit product and a two-unit product.

Figure 4:
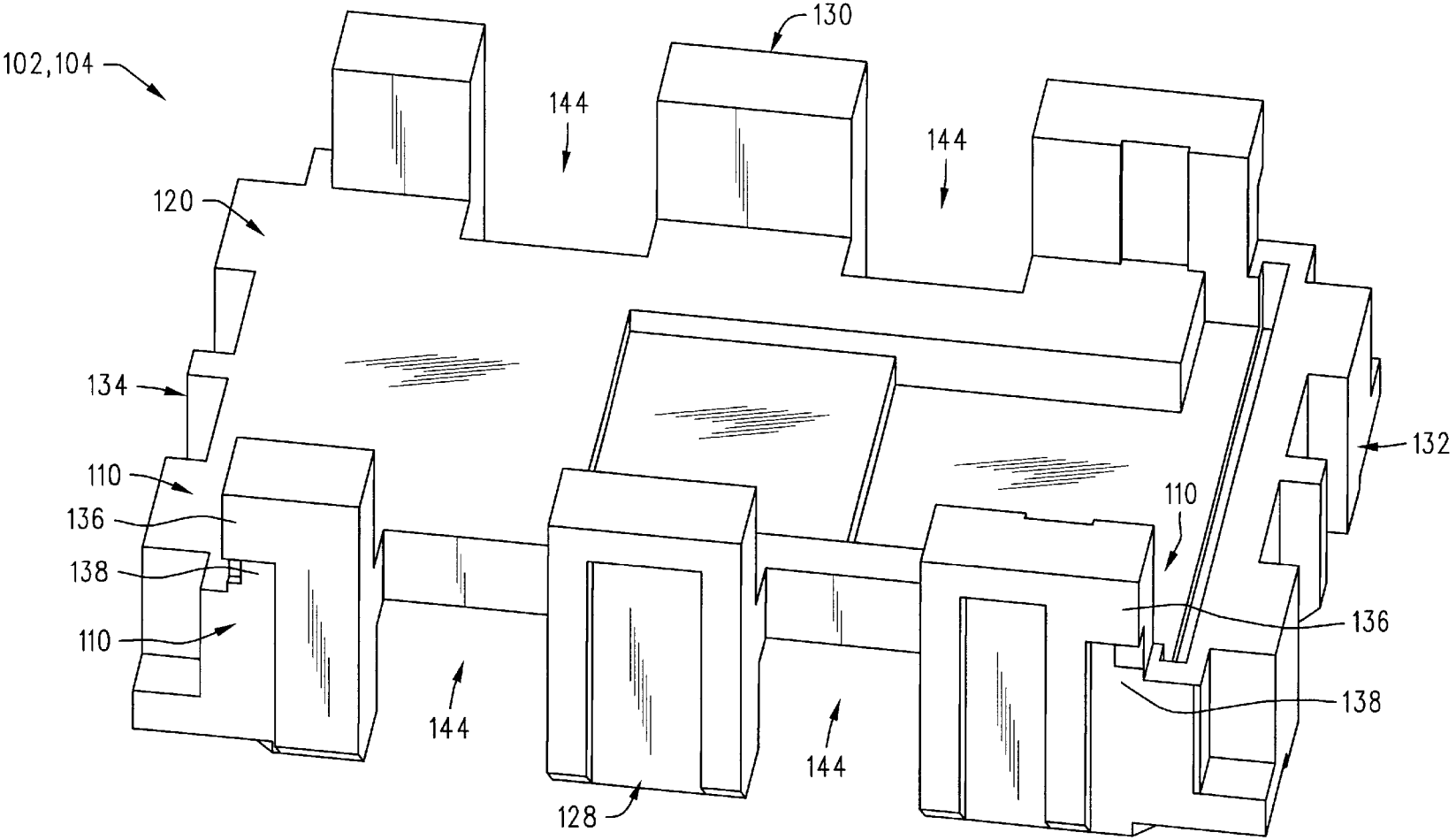
FIG. 4 is an isometric view of a top or bottom cushion of the packaging system of FIGS. 2 and 3 showing the inner surface of the cushion.
Figure 5:
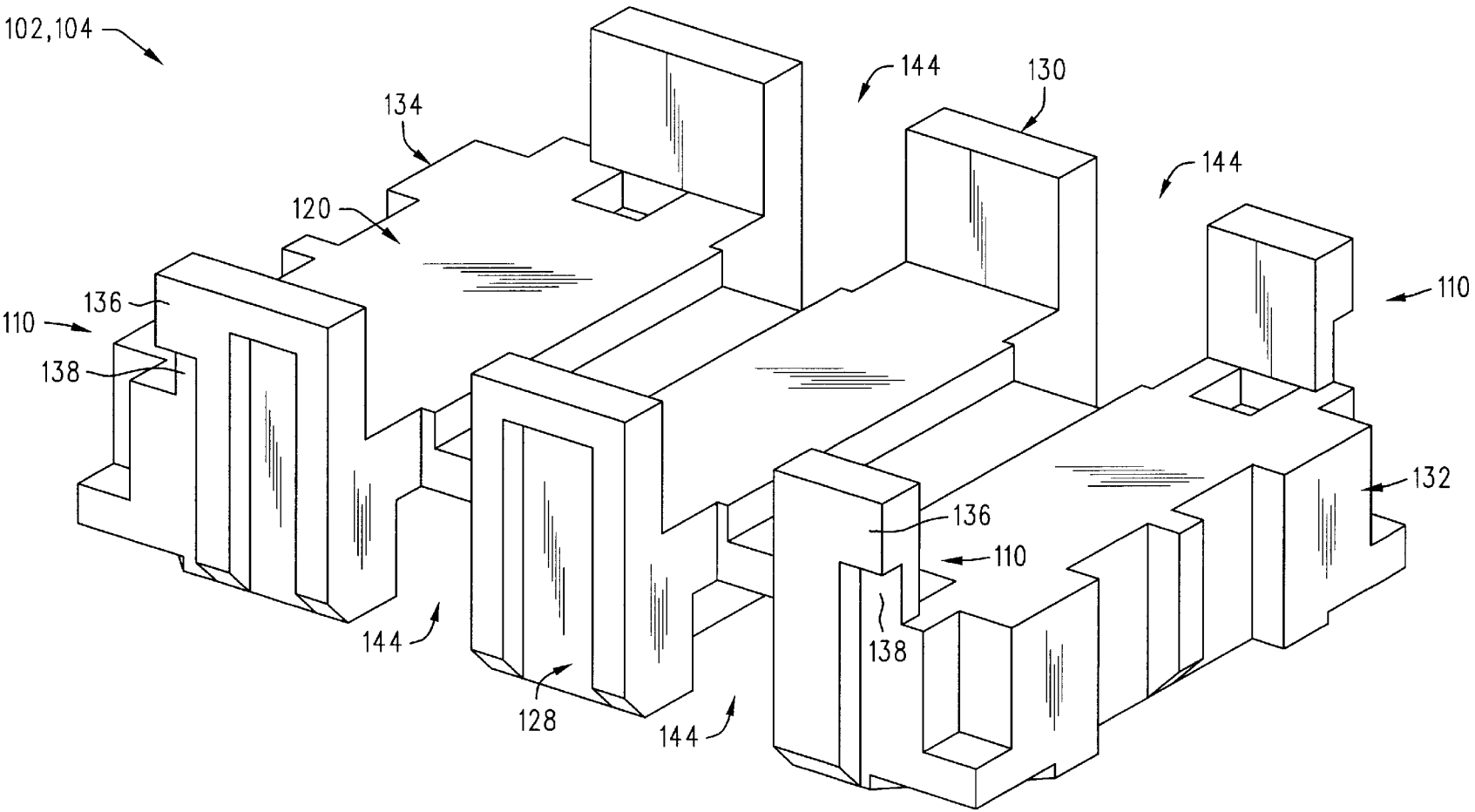
FIG. 5 is an isometric view of a top or bottom cushion of the packaging system of FIGS. 2 and 3 showing an alternate inner surface.
Figure 6:
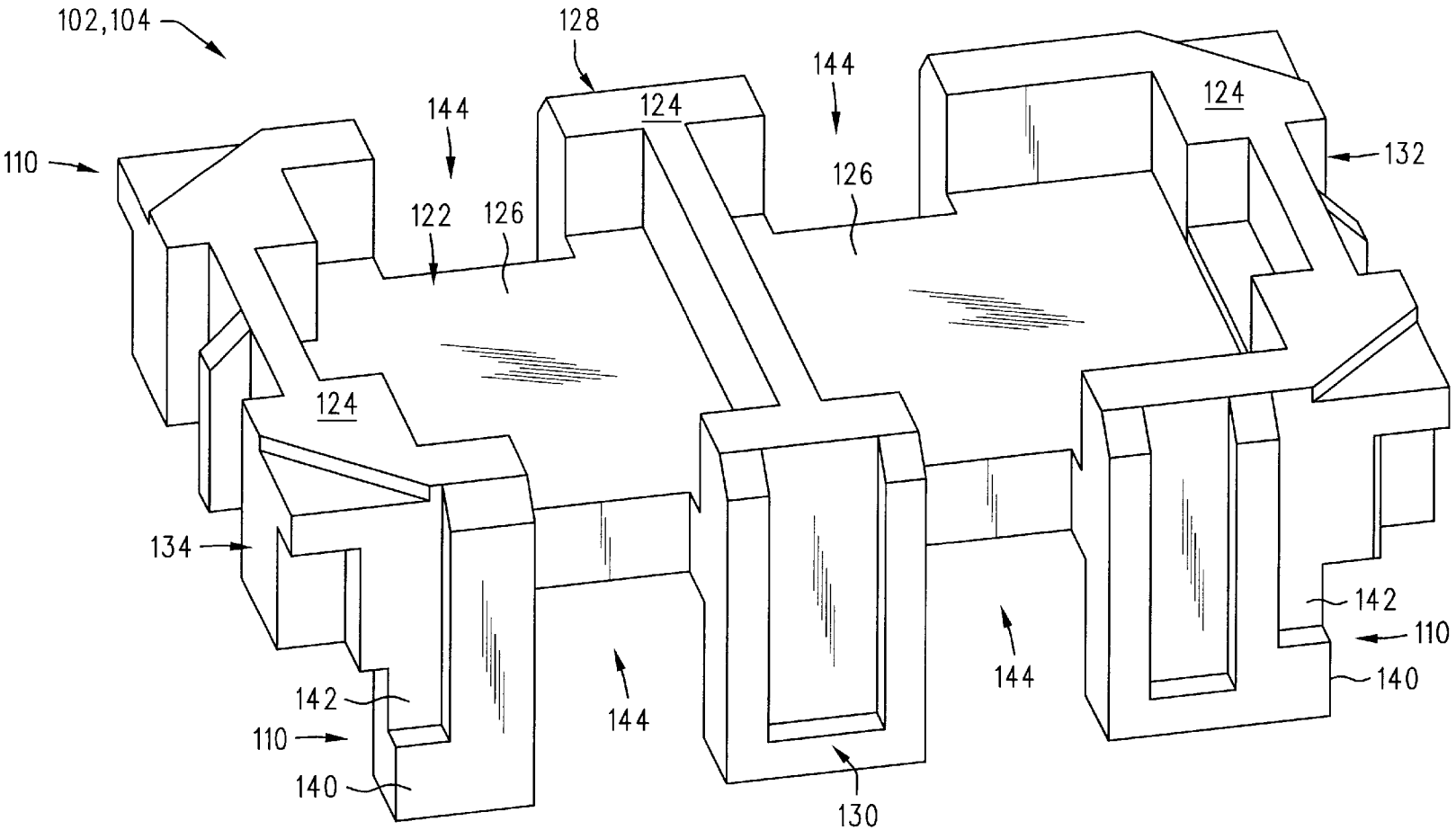
FIG. 6 is an isometric view of the top or bottom cushion of FIGS. 4 or 5 showing the outer surface of the cushion.

FIGS. 4–6 illustrate either a top cushion 102 or a bottom cushion 104. In a preferred embodiment, the top cushion 102 and the bottom cushion 104 are identical and interchangeable. As shown in FIG. 4 and with reference to FIG. 1, the top/bottom cushion 102, 104 may comprise an inner surface 120 which is adapted to abut the top side 22, 42, 62 or the bottom side 24, 44, 64 of any of the products 12, 14, 16 in the family 10 (FIG. 1). While a particular inner surface 120 configuration is shown in FIG. 4, it is to be understood that the inner surface 120 may have any surface configuration, and that this configuration may vary depending on the top/bottom surface configuration of the product it is used on. It is common practice to design the inner surface configuration such that the packaging abuts the product at a "strong" point on the product. An example of an alternate inner surface 120 configuration is shown in FIG. 5.

As shown in FIG. 6, the top/bottom cushion 102, 104 may also comprise an outer surface 122 having an outermost surface area 124 which is generally flat and adapted to abut the inside of a corrugated box (not shown) within which the product and packaging may be placed for shipment. The outer surface 122 may further comprise one or more cutout portions 126 which are adapted to receive and retain accessories such as cords, documentation, etc. The cutout portions 126 may be any size and configuration, so long as there is sufficient outermost surface area 124 to support the cushion 102, 104 and product therein.

As shown in FIGS. 4–6, the top/bottom cushion 102, 104 may further comprise a first side 128, a second side 130, a third side 132, and a fourth side 134. The first and second sides 128, 130 may extend generally laterally to the inner and outer surfaces 120, 122 and partially over the product, e.g., 16, as shown in FIG. 2. As best shown in FIG. 4, the first side 128 may comprise a pair of interlocking portions 110 which may be comprised of extending portions 136 and receiving portions 138. Each of the receiving portions 138 are recessed from the extending portions 136 (e.g., the receiving portions 138 may simply be cutouts). As best shown in FIG. 6, the second side 130 may also comprise a pair of interlocking portions 110 which may also be comprised of extending portions 140 and receiving portions 142. Again, each of the receiving portions 142 are recessed from the extending portions 140 (e.g., the receiving portions 142 may simply be cutouts). As shown in FIGS. 4–6, the first and second sides 128, 130 of the top/bottom cushion 102, 104 may further comprise "relief" areas 144, which may be recessed areas or cutouts, to allow the packaged product to be grasped and lifted up by a customer, forklift, etc.

FIGS. 7–10 illustrate the first side cushion 106 and the second side cushion 108. While these cushions 106, 108 are not identical in the figures, it is to be understood that, depending on the product it is used on, these cushions may be identical and interchangeable.

Figure 7:
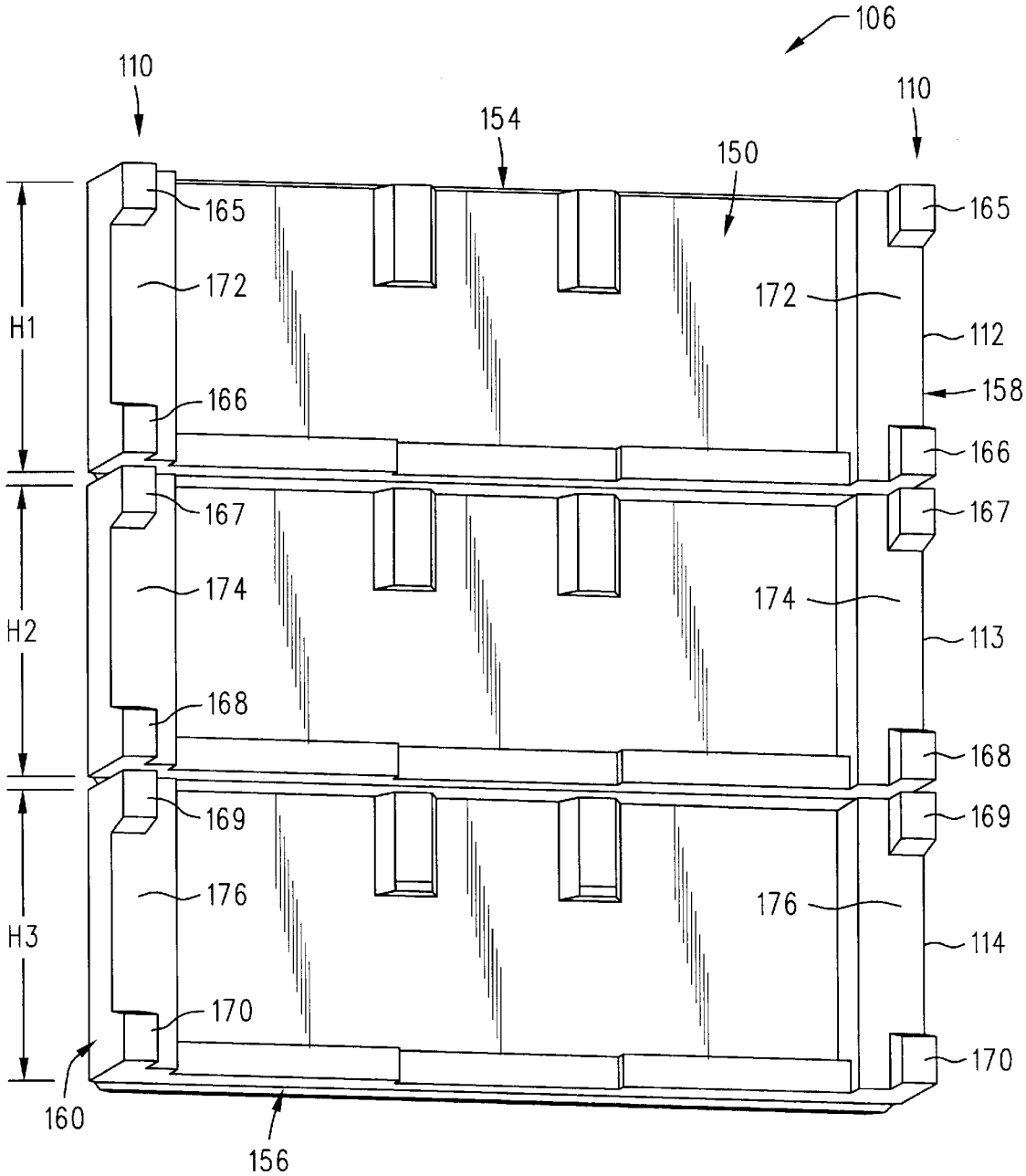
FIG. 7 is an isometric view of a first side cushion of the packaging system of FIGS. 2 and 3 showing the inner surface of the cushion.
Figure 8:
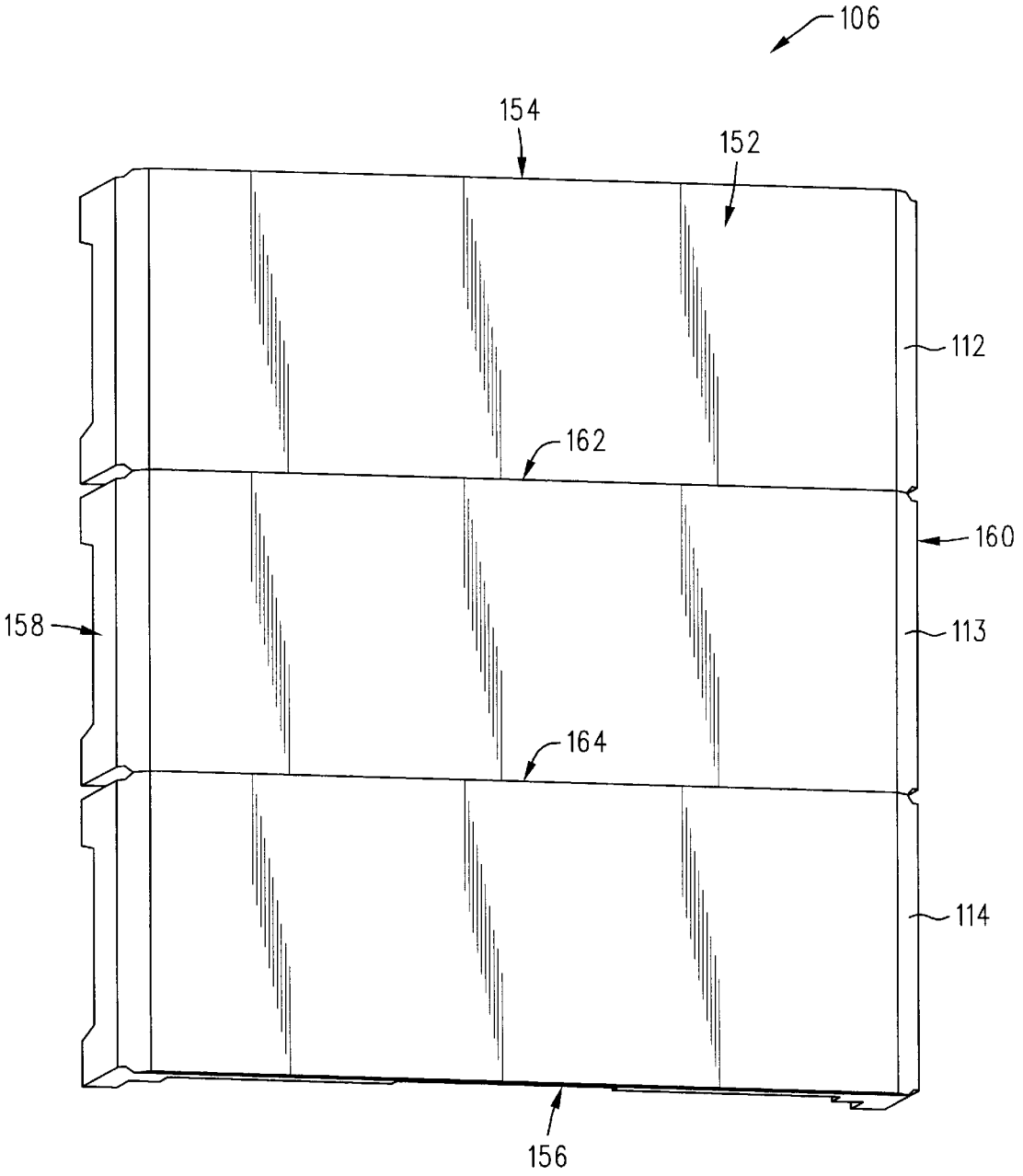
FIG. 8 is an isometric view of the first side cushion of FIG. 7 showing the outer surface of the cushion.

As shown in FIGS. 7 and 8, the first side cushion 106 may comprise an inner surface 150, an outer surface 152, a top side 154, and a bottom side 156. The first side cushion 106 may further comprise a first side 158 and a second side 160 which extend generally laterally to the inner and outer surfaces 150, 152. The inner surface 150, FIG. 7, is adapted to abut the first side 26, 46, 66 of any of the products 12, 14, 16 in the family 10 (FIG. 1). The outer surface 152, FIG. 8, is preferably generally flat as shown and is adapted to abut the inside of a corrugated box (not shown) within which the product and packaging may be placed for shipment.

As noted above and shown in FIGS. 7 and 8, the first side cushion 106 may comprise a first break-away portion 112, a second break-away portion 113, and a third break-away portion 114. For a one-unit product 12 (FIG. 1), the second and third break-away portions 113, 114 may be broken away (and utilized on other units if desired), leaving only the first break-away portion 112. The first side cushion 106, comprising only the first break-away portion 112, may then be placed on the first side 26 of a one-unit product 12 (FIG. 1). For a two-unit product 14 (FIG. 1), only the third break-away portion 114 is broken away (and utilized on a one-unit product if desired), leaving the first and second break-away portions 112, 113 intact. The first side cushion 106, comprising the first and second break-away portions 112, 113, may then be placed on the first side 46 of a two-unit product 14 (FIG. 1). While the break-away portions 112, 113, 114 may be identical as shown in FIGS. 7 and 8, these portions may be distinct so that the first side cushion 106 may be utilized on a product having distinct units. In other words, the break-away portions may have either identical or distinct inner surface configurations and identical or different heights H1, H2, H3, depending on the surface configuration of the product it is being used on.

As best shown in FIG. 8, the break-away portions 112, 113, 114 may be held together by attachment portions 162, 164. These attachment portions 162, 164 are preferably strong enough to hold the break-away portions 112, 113, 114 together when the first side cushion 106 is utilized on a two-unit 14 or three-unit product 16 (FIG. 1), yet allow the break-away portions 112, 114, 116 to be relatively easily separated from one another.

As shown in FIG. 7, the first side cushion 106 may further comprise a plurality of extending portions 165, 166, 167, 168, 169, 170 on the first and second sides 158, 160 thereof. The first side cushion 106 may also comprise a plurality of receiving portions 172, 174, 176 on the first and second sides 158, 160 thereof. The receiving portions 172, 174, 176 are recessed from the extending portions 165, etc., and may simply be cutouts as shown in FIG. 7.

Figure 9:
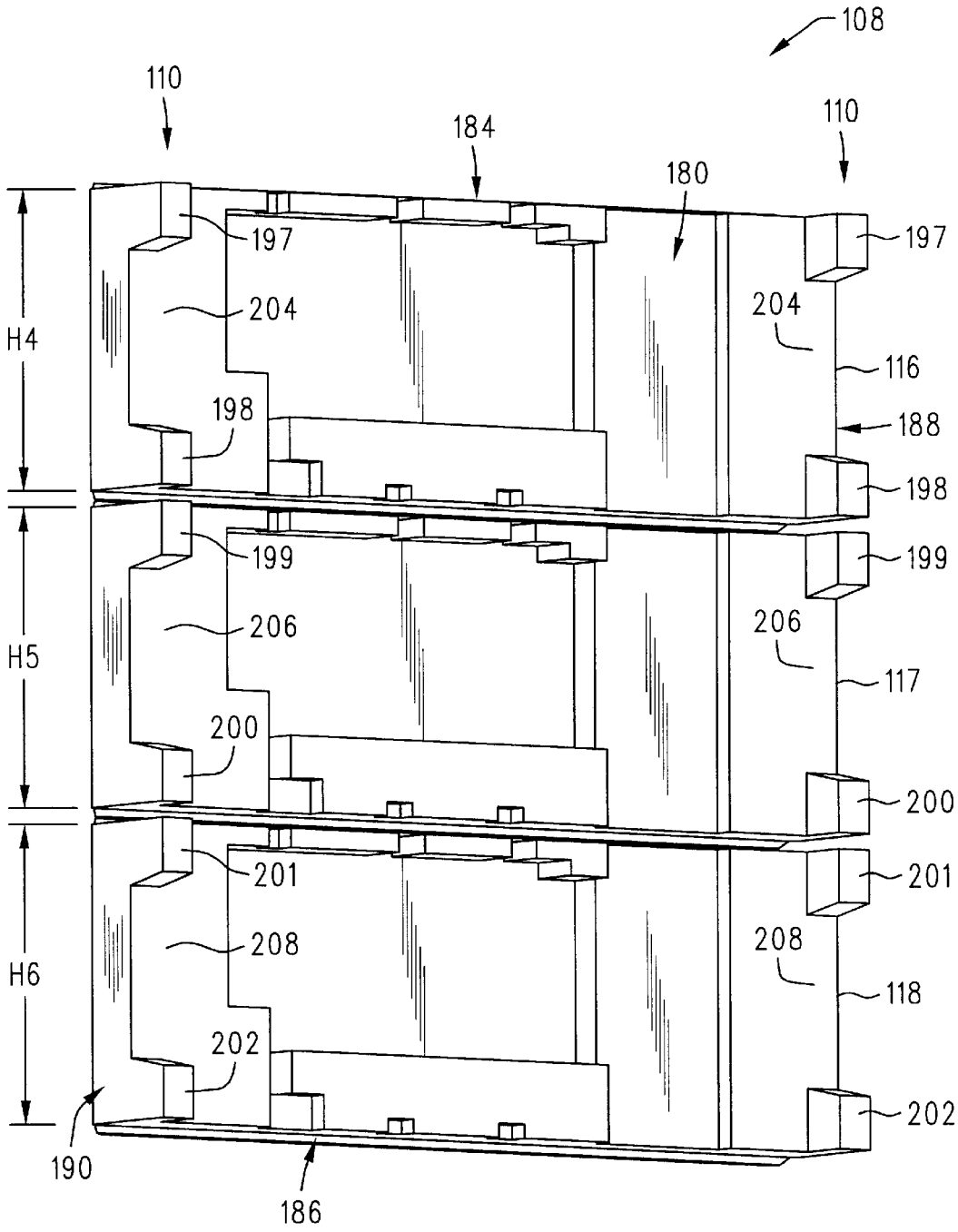
FIG. 9 is an isometric view of a second side cushion of the packaging system of FIGS. 2 and 3 showing the inner surface of the cushion.
Figure 10:
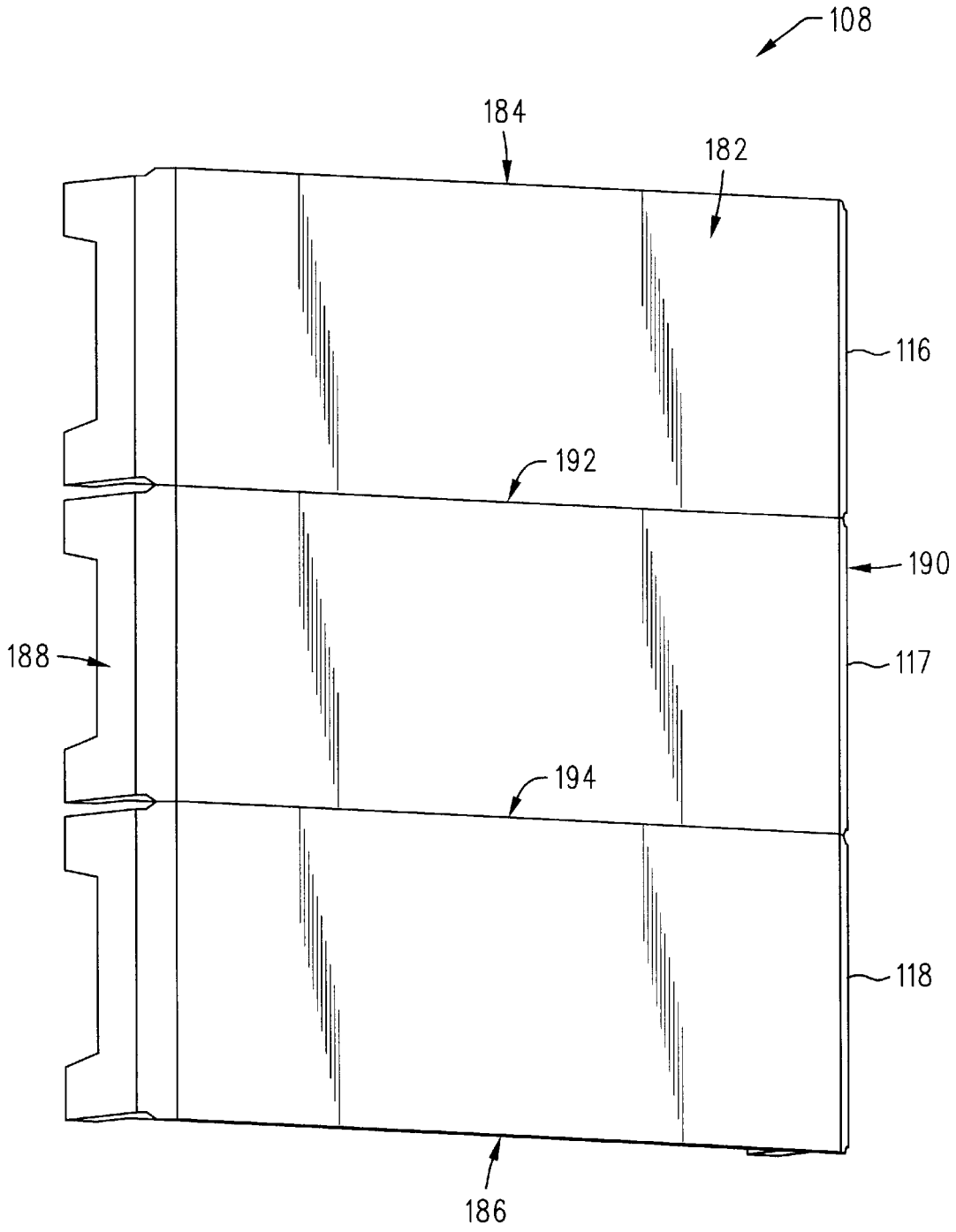
FIG. 10 is an isometric view of the second side cushion of FIG. 9 showing the outer surface of the cushion.

As shown in FIGS. 9 and 10, the second side cushion 108 may comprise an inner surface 180, an outer surface 182, a top side 184, and a bottom side 186. The second side cushion 108 may further comprise a first side 188 and a second side 190 which extend generally laterally to the inner and outer surfaces 180, 182. The inner surface 180, FIG. 9, is adapted to abut the second side 28, 48, 68 of any of the products 12, 14, 16 in the family 10 (FIG. 1). The outer surface 182, FIG. 10, is preferably generally flat as shown and is adapted to abut the inside of a corrugated box (not shown) within which the product and packaging may be placed for shipment.

As noted above and shown in FIGS. 9 and 10, the second side cushion 108 may comprise a first break-away portion 116, a second break-away portion 117, and a third break-away portion 118. For a one-unit product 12 (FIG. 1), the second and third break-away portions 117, 118 may be broken away (and utilized on other units if desired), leaving only the first break-away portion 116. The second side cushion 108, comprising only the first break-away portion 116, may then be placed on the second side 28 of a one-unit product 12 (FIG. 1). For a two-unit product 14 (FIG. 1), only the third break-away portion 118 is broken away (and utilized on a one-unit product if desired), leaving the first and second break-away portions 116, 117 intact. The second side cushion 108, comprising the first and second break-away portions 116, 117, may then be placed on the second side 48 of a two-unit product 14 (FIG. 1). While the break-away portions 116, 117, 118 may be identical as shown in FIGS. 9 and 10, these portions may be distinct so that the second side cushion 108 may be utilized on a product having distinct units. In other words, the break-away portions may have either identical or distinct inner surface configurations and identical or different heights H4, H5, H6, depending on the surface configuration of the product it is being used on. However, the heights H4, H5, H6 of the break-away portions 116, 117, 118 on the second side cushion 108 preferably correspond to the height H1, H2, H3 of the break-away portions 112, 113, 114 on the first side cushion 106 (FIG. 7) so that these cushions 106, 108 can be utilized on the same family of products. In other words, H1 is equal to H4, H2 is equal to H5, and H3 is equal to H6.

As best shown in FIG. 10, the break-away portions 116, 117, 118 may be held together by attachment portions 192, 194. As with attachment portions 162, 164 (FIG. 8), the attachment portions 192, 194 are preferably strong enough to hold the break-away portions 116, 117, 118 together when the second side cushion 108 is utilized on a two-unit 14 or three-unit product 16 (FIG. 1), yet allow the break-away portions 116, 117, 118 to be relatively easily separated from one another.

It is to be understood that, while only three break-away portions are shown in the previous figures, as many break-away portions as desired may be utilized in the packaging system of the present invention. For example, should a family of products contain a one-unit product, two-unit product, three-unit product, four-unit product, and five-unit product, first and second side cushions having five break-away portions may be manufactured in accordance with the present invention. Furthermore, while particular inner surface configurations are shown in FIGS. 7 and 9, it is to be understood that the inner surface 150, 180 of the first and second side cushions 106, 108, respectively, may have any surface configuration, and that this configuration may vary depending on the surface configurations of the sides of the product these cushions are being used on. Furthermore, the inner surfaces 150, 180 as well as the outer surfaces 152, 182 of the first and second side cushions 106, 108 may be identical, if desired, making the first and second side cushions 106, 108 identical and interchangeable. Also, as noted above, a third side cushion and a fourth side cushion (not shown) may also be provided which are adapted to be placed on the third side 30, 50, 70 and fourth side 32, 52, 72, respectively, of a product 12, 14, 16 in order to form a fully-enclosed packaging unit (not shown). The third side cushion and the fourth side cushion each have inner surfaces and outer surfaces which may be identical to or distinct from one another, and also may be identical to or distinct from the inner surfaces 150, 180 and outer surfaces 152, 182 of the first and second side cushions 106, 108, respectively.

As shown in FIG. 9, the second side cushion 108 may further comprise a plurality of extending portions 197, 198, 199, 200, 201, 202 on the first and second sides 188, 190 thereof. The second side cushion 108 may also comprise a plurality of receiving portions 204, 206, 208 on the first and second sides 188, 190 thereof. The receiving portions 204, 206, 208 are recessed from the extending portions 197, etc., and may simply be cutouts as shown in FIG. 9.

Regardless of whether two or four side cushions are utilized in the packaging system of the present invention, these cushions securely, removably interlock with each other and with the top cushion and the bottom cushion to form a packaging unit as noted above and shown in FIG. 2. Each of the side cushions must be removed prior to removing the top and bottom cushions in order to unlock the packaging unit. When the cushions are interlocked together as shown in FIG. 2, the top side 154 (FIGS. 7–8) of the first side cushion 106 is adjacent to and preferably abuts the first side 132 (FIGS. 4–6) of the top cushion 102, and the bottom side 156 (FIGS. 7–8) of the first side cushion 106 is adjacent to and preferably abuts the first side 132 (FIGS. 4–6) of the bottom cushion 104. Furthermore, the top side 184 (FIGS. 9–10) of the second side cushion 108 is adjacent to and preferably abuts the second side 134 (FIGS. 4–6) of the top cushion 102, and the bottom side 186 (FIGS. 9–10) of the second cushion 108 is adjacent to and preferably abuts the second side 134 (FIGS. 4–6) of the bottom cushion 104. Also as shown in FIG. 2, receiving portions 138, 142 (FIGS. 4–6) on the top and bottom cushions 102, 104 receive extending portions 165, 170 (FIG. 7) on the first side cushion 106 and extending portions 197, 202 (FIG. 9) on the second side cushion 108. Receiving portions 172, 176 (FIG. 7) on the first side cushion 106 and receiving portions 204, 208 (FIG. 9) on the second side cushion 108) receive extending portions 136, 140 (FIGS. 4–6) on the top and bottom cushions 102, 104. If break-away portions are broken away from the first and second side cushions 106, 108, then different extending and receiving portions may be utilized on these cushions. For example, if break-away portions 112, 113, 116 and 117 are broken away from the cushions 106, 108, leaving portions 114 and 118 for use with a one-unit product, then extending portions 169, 201 (FIGS. 7 and 9) and receiving portions 176, 208 are utilized. As another example, should break-away portions 112 and 116 be broken away, leaving portions 113, 114 and 117, 118 for use with a two-unit product, then extending portions 167, 199 (FIGS. 7 and 9) and receiving portions 174, 206 are utilized.

Figure 11:
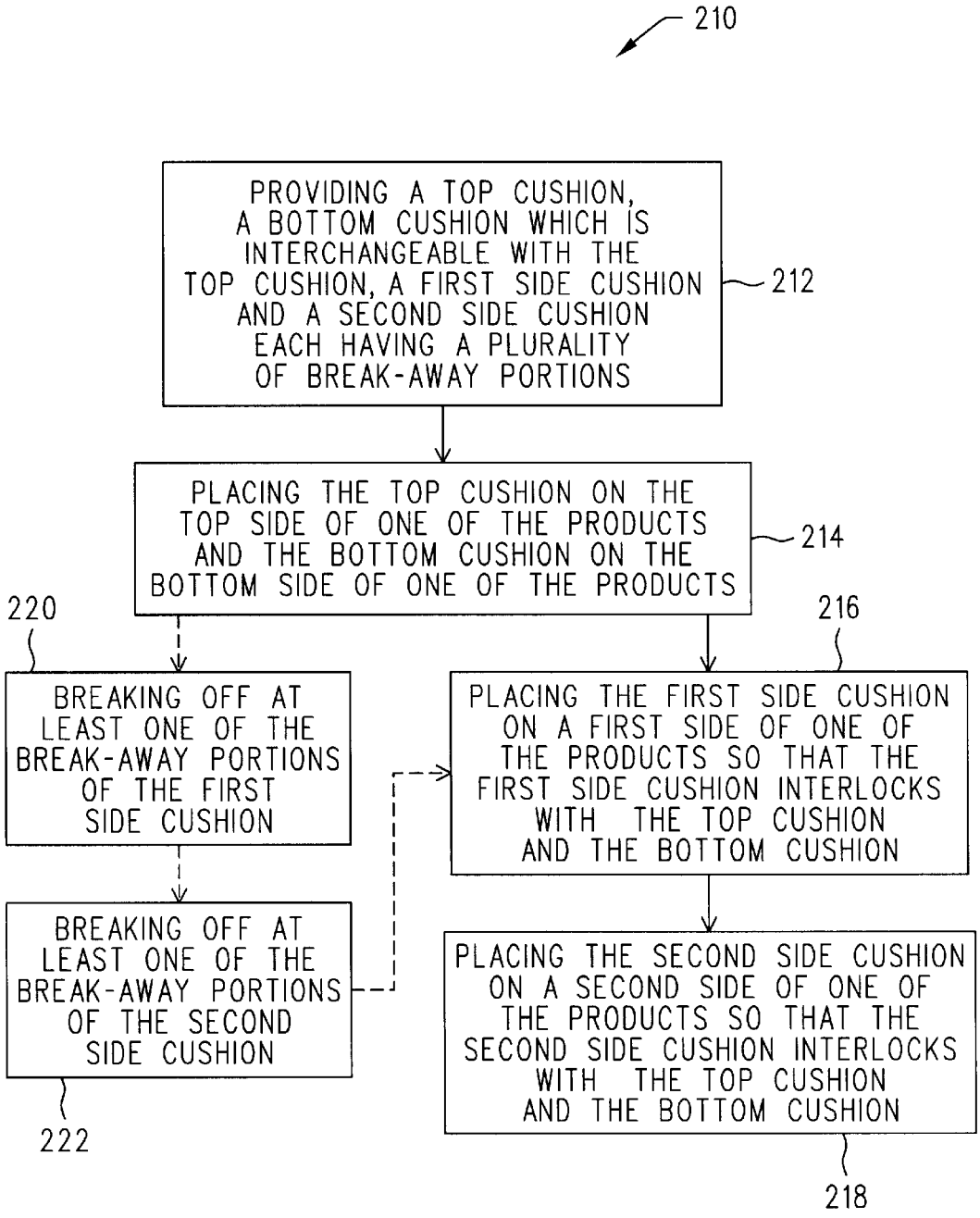
FIG. 11 is a flow chart illustrating a method for packaging a family of products.

FIG. 11 illustrates a method 210 for packaging a family 10 of products 12, 14, 16 (FIG. 1). With reference also to FIGS. 1–10, the first step 212 involves providing the packaging system 10 as described above. Specifically, a top cushion 102, an identical bottom cushion 104, and two side cushions 106, 108 each having a plurality of break-away portions 112, 113, 114, 116, 117, 118 are provided. The next step 214 involves placing the top cushion 102 on the top side 22, 42, 62 and the bottom cushion 104 on the bottom side 24, 44, 64 of one of the products 12, 14, 16. The next step 216 involves placing the first side cushion 106 on a first side 26, 46, 66 of one of the products 12, 14, 16 so that the first side cushion 106 interlocks with the top cushion 102 and the bottom cushion 104. The next step 218 involves placing the second side cushion 108 on a second side 28, 48, 68 of one of the products 12, 14, 16 so that the second side cushion 108 interlocks with the top cushion 102 and the bottom cushion 108. Alternative steps 220, 222 may be performed prior to the previous two steps 216, 218. These steps 220, 222 involve breaking off at least one of the break-away portions 112, 113, 114 and 116, 117, 118 of each of the first side cushion 106 and second side cushion 108, respectively. These alternative steps 220, 222 would be performed for products comprising fewer units (e.g., one or two) than the product with the most units (e.g., three) in a family.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

I claim:

1. A packaging system for a family of products, each of said products comprising a top side, a bottom side, a first side, a second side, a third side, and a fourth side, said packaging system comprising:

a) a top cushion adapted to be placed on said top side of any of said products in said family;

b) a bottom cushion which is identical to and interchangeable with said top cushion, said bottom cushion being adapted to be placed on said bottom side of any of said products in said family;

c) a first side cushion adapted to be placed on said first side of a first one of said products in said family, said first side cushion comprising at least one break-away portion which allows said first side cushion to be utilized on said first side of at least a second one of said products in said family;

d) a second side cushion adapted to be placed on said second side of said first one of said products in said family, said second side cushion comprising at least one break-away portion which allows said second side cushion to be utilized on said second side of at least said second one of said products in said family; and e) interlocking portions adapted to securely, removably interlock said top cushion and said bottom cushion with said first side cushion and said second side cushion to form a packaging unit.

2. The packaging system of claim 1, wherein:

a) said first side cushion comprises two break-away portions which allow said first side cushion to be utilized on said first side of a third one of said products in said family; and b) said second side cushion comprises two break-away portions which allow said second side cushion to be utilized on said second side of said third one of said products in said family.

3. The packaging system of claim 1, said family of products being comprised of substantially identical units, wherein each of said break-away portions are substantially identical.

4. The packaging system of claim 1 wherein said second side cushion is identical to and interchangeable with said first side cushion.

5. The packaging system of claim 1, said interlocking portions comprising:

a) extending portions on each of said top cushion, bottom cushion, first side cushion and said second side cushion; and b) receiving portions on each of said top cushion, bottom cushion, first side cushion and second side cushion, said receiving portions being recessed from said extending portions, whereby said receiving portions are adapted to receive and interlock with said extending portions.

6. The packaging system of claim 1 wherein removing said first side cushion and said second side cushion unlocks said packaging unit.

7. The packaging system of claim 1 wherein at least one of said top cushion, said bottom cushion, said first side cushion, and said second side cushion comprise at least one cutout portion adapted to receive accessories.

8. The packaging system of claim 1, said top cushion and said bottom cushion comprising a plurality of relief areas.

9. A packaging system for a family of products, said family being comprised of at least a one-unit product, a two-unit product, and a three-unit product, and each of said products having a top side, a bottom side, a first side, a second side, a third side, and a fourth side, said packaging system comprising:

a) a top cushion adapted to be placed on said top side of any of said products in said family;

b) a bottom cushion which is identical to and interchangeable with said top cushion, said bottom cushion being adapted to be placed on said bottom side of any of said products in said family;

c) a first side cushion adapted to be placed on said first side of any of said products in said family, said first side cushion comprising at least a first break-away portion, a second break-away portion, and a third break-away portion which allows said first side cushion to be utilized on any of said products in said family, wherein said first break-away portion is adapted for use on said one-unit product, said first break-away portion and said second break-away portion are adapted for use on said two-unit product, and said first break-away portion, said second break-away portion, and said third break-away portion are adapted for use on said three-unit product;

d) a second side cushion adapted to be placed on said second side of any of said products in said family, said second side cushion comprising at least a first break-away portion, a second break-away portion, and a third break-away portion which allows said second side cushion to be utilized on any of said products in said family, wherein said first break-away portion is adapted for use on said one-unit product, said first break-away portion and said second break-away portion are adapted for use on said two-unit product, and said first break-away portion, said second break-away portion, and said third break-away portion are adapted for use on said three-unit product; and e) interlocking portions adapted to securely, removably interlock said top cushion and said bottom cushion with said first side cushion and said second side cushion to form a packaging unit, wherein removing said first side cushion and said second side cushion unlocks said packaging unit.

10. The packaging system of claim 9, said family of products being comprised of substantially identical units, wherein each of said break-away portions are substantially identical.

11. The packaging system of claim 9 wherein said second side cushion is identical to and interchangeable with said first side-cushion.

12. The packaging system of claim 9, said interlocking portions comprising:

a) extending portions on each of said top cushion, bottom cushion, first side cushion and said second side cushion; and b) receiving portions on each of said top cushion, bottom cushion, first side cushion and second side cushion, said receiving portions being recessed from said extending portions, whereby said receiving portions are adapted to receive and interlock with said extending portions.

13. The packaging system of claim 9 wherein at least one of said top cushion, said bottom cushion, said first side cushion, and said second side cushion comprise at least one cutout portion adapted to receive accessories.

14. The packaging system of claim 9, said top cushion and said bottom cushion comprising a plurality of relief areas.

15. A method for packaging a family of products, comprising:

a) providing a top cushion, a bottom cushion which is interchangeable with said top cushion, a first side cushion and a second side cushion each having a plurality of break-away portions;

b) placing said top cushion on the top side of one of said products and said bottom cushion on the bottom side of said one of said products;

c) placing said first side cushion on a first side of said one of said products so that said first side cushion interlocks with said top cushion and said bottom cushion; and d) placing said second side cushion on a second side of said one of said products so that said second side cushion interlocks with said top cushion and said bottom cushion.

16. The method of claim 15 further comprising, prior to the step of placing said first side cushion on a first side of said one of said products:

a) breaking off at least one of said break-away portions of said first side cushion; and b) breaking off at least one of said break-away portions of said second side cushion.

17. A packaging system for a family of products, comprising:

a) a first cushion means for covering a top side of each of said products;

b) a second cushion means for covering a bottom side of each of said products;

c) a third cushion means for covering a first side of each of said products;

d) a fourth cushion means for covering a second side of each of said products;

e) break-away means for allowing said third cushion means and said fourth cushion means to be utilized on any of said products in said family; and e) interlocking means for securely, removably interlocking said first cushion means and said second cushion means with said third cushion means and said fourth cushion means on each of said products.

18. A packaging system for a family of products having a plurality of unit products with each of said plurality of unit products having a top, a bottom, and a plurality of sides, said packaging system comprising:

a) a first side cushion having first sets of break-away portions, with each of said first sets adapted for individual use with one of said plurality of unit products;

b) a second side cushion having second sets of break-away portions, with each of said second sets adapted for individual use with one of said plurality of unit products;

c) third cushions, each of third cushions adapted to be used on a top or bottom of each of said plurality of unit products;

d) interlocking portions adapted to securely, removably interlock one of said third cushions used as a top cushion and one of said third cushions used as a bottom cushion with said first side cushion and said second side cushion to form a packaging unit, wherein removing said first side cushion and said second side cushion unlocks said packaging unit.

* * * * *